US007333760B2

(12) United States Patent
Baba et al.

(10) Patent No.: US 7,333,760 B2
(45) Date of Patent: Feb. 19, 2008

(54) FIXING DEVICE WITH TEMPERATURE CONTROL

(75) Inventors: Toshihiko Baba, Ohta-ku (JP); Shigeo Kurotaka, Sagamihara (JP); Katsuhiro Echigo, Asaka (JP); Takashi Fujita, Yokohama (JP); Hisashi Kikuchi, Kawasaki (JP); Yukimichi Someya, Saitama (JP); Hiroyuki Kunii, Yokohama (JP); Atsushi Nakafuji, Ohta-ku (JP); Kohji Ue, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 11/165,021

(22) Filed: Jun. 24, 2005

(65) Prior Publication Data

US 2005/0286920 A1 Dec. 29, 2005

(30) Foreign Application Priority Data

Jun. 24, 2004 (JP) ..... 2004-185744

(51) Int. Cl.
*G03G 15/16* (2006.01)
*G03G 15/20* (2006.01)

(52) U.S. Cl. ..... 399/307; 399/328; 399/329; 399/334

(58) Field of Classification Search ..... 399/307, 399/328, 329, 330, 334, 335; 219/619
See application file for complete search history.

(56) References Cited

U.S. PATENT DOCUMENTS 4,985,733 A 1/1991 Kurotori et al.
4,987,457 A 1/1991 Mochizuki et al.
5,155,534 A 10/1992 Kurotori et al.
5,592,275 A 1/1997 Echigo et al.
5,708,949 A 1/1998 Kasahara et al.
6,108,906 A 8/2000 Fujita et al.
6,122,479 A 9/2000 Fujita et al.
6,535,701 B2 3/2003 Baba
6,542,705 B2 4/2003 Fujita et al.
6,559,421 B1 5/2003 Yura et al.

(Continued)

FOREIGN PATENT DOCUMENTS

JP 2000-206813 7/2000

(Continued)

OTHER PUBLICATIONS

U.S. Appl. No. 11/511,380, filed Aug. 29, 2006, Suzuki, et al.

(Continued)

*Primary Examiner*—William J. Royer
(74) *Attorney, Agent, or Firm*—Oblon, Spivak, McClelland, Maier & Neustadt, P.C.

(57) ABSTRACT

A fixing device including a magnetic field generating device to generate a magnetic field, a fixing member to heat a recording material by heat generated in a first recording material passing area having a first width on the fixing member by electromagnetic induction heat generation by the magnetic field formed by the magnetic field generating device, a pressing member to form a nip portion where the pressing member and the fixing member press against each other to fix an unfixed image on the recording material, and at least one radiation heating device configured to heat a second recording material passing area having a second width.

18 Claims, 7 Drawing Sheets

U.S. PATENT DOCUMENTS

| | | | | |
|---|---|---|---|---|
| 6,631,253 | B2 | 10/2003 | Nakafuji et al. | |
| 6,636,718 | B2 | 10/2003 | Yura et al. | |
| 6,646,227 | B2 | 11/2003 | Yura et al. | |
| 6,721,532 | B2 | 4/2004 | Kosugi et al. | |
| 6,795,676 | B2 | 9/2004 | Kikuchi et al. | |
| 6,795,678 | B2 | 9/2004 | Yura et al. | |
| 6,847,792 | B2 | 1/2005 | Nakafuji et al. | |
| 6,885,843 | B2 * | 4/2005 | Park | 399/307 |
| 6,978,110 | B2 * | 12/2005 | Nakayama | 399/330 |
| 7,058,329 | B2 * | 6/2006 | Takahashi | 399/328 |
| 7,098,430 | B2 * | 8/2006 | Kondo et al. | 219/619 |
| 7,162,168 | B2 * | 1/2007 | Kunimori | 399/328 |
| 2004/0022552 | A1 | 2/2004 | Yura et al. | |
| 2004/0037595 | A1 | 2/2004 | Takashi et al. | |
| 2004/0086293 | A1 | 5/2004 | Atsushi et al. | |
| 2004/0111888 | A1 | 6/2004 | Yura et al. | |
| 2004/0190959 | A1 | 9/2004 | Kikuchi et al. | |
| 2004/0245235 | A1 | 12/2004 | Kishi et al. | |
| 2004/0265017 | A1 | 12/2004 | Kikuchi et al. | |

FOREIGN PATENT DOCUMENTS

| | | |
|---|---|---|
| JP | 2001-117401 | 4/2001 |
| JP | 2003-228249 | 8/2003 |

OTHER PUBLICATIONS

U.S. Appl. No. 11/521,494, filed Sep. 15, 2006, Takagaki, et al.
U.S. Appl. No. 11/669,817, filed Jan. 31, 2007, Suzuki, et al.
U.S. Appl. No. 11/681,739, filed Mar. 2, 2007, Seto, et al.
U.S. Appl. No. 11/683,086, filed Mar. 7, 2007, Takemoto, et al.
U.S. Appl. No. 11/757,150, filed Jun. 1, 2007, Seto, et al.

* cited by examiner

FIXING DEVICE WITH TEMPERATURE CONTROL

BACKGROUND OF THE INVENTION

1. Field of the Invention

The present invention relates to a fixing device for use in an image forming apparatus adopting an electrophotographic system, and particularly relates to a fixing device in which the temperature is prevented from rising at its end portions.

2. Discussion of the Background

A typical fixing system for use in electrophotography is a thermal roller fixing system including a fixing roller containing a heat source therein and a pressing roller covered with an elastic body. The surface of the fixing roller is also covered with a non-adhesive elastic body. In this system, a toner borne on a recording material is fixed upon application of heat and pressure when a recording material passes between both rollers. However, since this thermal roller fixing system uses a fixing roller having a large thermal capacity, the time needed before the fixing roller is heated to a temperature at which fixing is possible is relatively long. Therefore, the warm-up time of the device is inevitably set to be long in most cases. Further, a large amount of power is needed to maintain the temperature of such a fixing roller, resulting in significant increase in power consumption of the fixing device or the entire image forming apparatus including the fixing device.

Recently, to address these drawbacks, there has been developed a device in which a metal core of a fixing roller has a thin thickness to have a low thermal capacity and a fixing system in which a toner borne on a recording material is fixed by the surface of a belt having a low thermal capacity. In a system in which a fixing member has a low thermal capacity, the thermal energy for fixing is substantially equal to the energy needed to simply heat the fixing member to a predetermined temperature so that the warm-up time can be shortened.

However, when a large number of small sized recording materials are continuously printed with a fixing device using a fixing member having such a low thermal capacity, the end portion of the fixing member in which materials do not pass is heated to a high temperature, which may lead to a life length problem of the fixing member. In addition, because the end portion of a recording material is heated to a relatively high temperature during a fixing process in comparison with the central portion thereof, the degree of the gloss increases at the end portion. As a result, there may be a difference in the gloss obtained between the central portion and the end portion of the recording material. Further, since the temperature at the area outside a small-sized recording material rises while a large number of the small-sized recording materials continuously pass, hot-offset and wound material jamming possibly occur to a large-sized material printed immediately thereafter.

To deal with these problems, various kinds of methods and techniques have been proposed. Published unexamined Japanese Patent Application No. (hereinafter referred to as JOP) H12-206813 describes a technique which provides a control unit having magnetic-substance cores separated in the axial direction of a fixing roller and exciting coils provided for the magnetic-substance cores, and controls the amount of power supplied to the heating coils at ends according to an amount of the supply of power to the heating coil in the middle.

In addition, JOP 2001-117401 describes a technique which provides a device having an endless fixing belt, on the surface layer of which a mold-released layer is formed, to be rotated while being spread between a heating roller composed of a conductive member and a fixing roller, on the surface layer of which an elastic layer is formed, an oil applying roller for applying a releasing material to the fixing belt, first and second magnetic field generating mechanisms installed near the heating roller each for heating the heating roller in the material passing width areas of sheets in mutually different sizes with eddy currents, a pressing roller provided to be press-contacted with the fixing roller from the upside of the fixing belt for forming a nip part in the gap between the fixing belt, and a temperature detecting mechanism for detecting the temperature of the heating roller heated by the magnetic field generating mechanism, and the heating roller is heated by the magnetic field generating mechanism corresponding to the size of a sheet to be passed.

Furthermore, JOP H08-220932 describes a technique in which a fixing device fixing a toner image on a recording sheet by making the recording sheet carrying the toner image pass through between a fixing roller incorporating a heater and a pressure roller which is brought into press-contact with the fixing roller is provided with a first heater having light distribution corresponding to a small-sized sheet area, and a second heater having the light distribution corresponding to end parts other than the small-sized sheet area. The sum total of the power of the first and the second heater is equal to or less than a power value required by the fixing device during standby, and is equal to or more than the power value required by the fixing device while forming an image, the respective power of the first and the second heater are equal to or less than the power value required by the fixing device while forming the image, temperature control is performed by the first and the second heaters in the case of warming-up time, and the temperature control is performed by the first heater or by switching the first heater to the second heater in the case of forming the image.

JOP 2003-228249 describes a technique in which a fixing belt is rotatably stretched between a heat roller, as a heat source for heating a sheet, and a fixing roller, and is heated by the heat roller. Using the heated fixing belt, a sheet passing through a press-contact portion between the fixing roller and a pressure roller is heated, thereby fixing a toner image to the sheet. At least two heat generation sources are disposed within the heat roller. Also, the at least two heat generation sources are independently controlled by a control means according to the size of a sheet. In addition, a specific portion of the fixing belt other than the contact portion of the fixing belt with the heat roller is heated by a heating device.

JOP 2001-296765 describes a technique of a heat fixing device in which a fixing roller and a pressure roller are oppositely held in press contact with each other. In assuming that the material sheet whose size is below the fill width of the fixing roller is made to pass on the fixing roller center part, a magnet is closely arranged on an outer periphery of the fixing roller along the material passage section. Since the quantity of heat generation due to eddy current generated in such a case of placing metal on a varying electric field increases, in accordance with the strength of a magnetic field, or the extent of a magnetic field variation, this heat generation is used as an auxiliary heat source supplementing heat consumption of the material passing art.

However, to wind an exciting coil around a magnetic core, which is illustrated in JOP H12-206813, is laborious. In addition, a magnetic field generating device must be accurately mounted. Therefore, such a magnetic field generating device has a poor assembling property. Also such a magnetic field generating device is costly. Therefore, when a plurality of such magnetic field generating devices are provided to prevent the temperature of the end portion of a recording material from rising, costs become extremely high. The technique described in JOP H12-206813 requires a plurality of magnetic field generating devices, resulting in significantly poor mountability and increase in costs. Further, since the amount of power supplied to the heating coils located at the ends is controlled depending on the amount of power supplied to the heating coil in the center, the control circuit is complicated, resulting in further increases in cost. Furthermore, since the coil is divided, the temperature is not uniform at the connecting points of the coils, thereby creating non-uniform gloss.

Similarly, in the technique of JOP 2001-117401, a plurality of magnetic field generating mechanisms are provided and therefore its cost is extremely high. In addition, even though the magnetic field generating mechanisms are space-consuming, the magnetic field generating mechanisms are arranged in two lines, resulting in increase in size. Further, halogen heaters, which are used in the technique of JOP 2001-117401, have a large thermal capacity themselves. Therefore, as compared with electromagnetic induction heat generation, heat generation efficiency is inferior and warm-up time is long.

In the technique of JOP H08-220932, since a halogen heater is the only heat source, the heat generation efficiency is inferior to that of a device using electromagnetic induction heat generation and the warm-up time is relatively long. As for the technique of JOP 2003-228249, an induction heating mechanism and at least two radiation heat generation sources are provided. However, the variance in the size of a material passing is dealt with only by the at least two radiation heat generation sources. In the technique described in JOP 2001-296765, the halogen heater and magnet are disposed irrespective of the variance in the size of a material passing.

SUMMARY OF THE INVENTION

Because of these reasons, the present inventors recognized a need exists for a fixing device which is space effective, cost effective, easy to mount, which can be quickly warmed up and by which a temperature rise in the fixing member included in the fixing device during a fixing process can be effectively prevented.

Accordingly, an object of the present invention is to provide a novel fixing device which is space effective, cost effective, easy to mount, quickly warms up, and by which a temperature rise in the fixing member included in the fixing device during a fixing process can be effectively prevented. A further object is to provide a novel image forming apparatus using the fixing device.

Briefly these objects and other objects of the present invention as hereinafter will become more readily apparent and can be attained by a fixing device including a fixing member to fix an unfixed image on a recording material upon application of heat and pressure, a magnetic field generating device to generate a magnetic field by which heat is generated through electromagnetic induction heat generation in a first recording material passing area having a first width on the fixing member, at least one radiation heating device to heat a second recording material passing area having a second width on the fixing member, and a pressing member to press the fixing member to form a nip portion between the pressing member and the fixing member and to fix the unfixed image on the recording material together with the fixing member.

It is preferred that, in the fixing device mentioned above, the first recording material passing area having a first width corresponds to a relatively larger-sized recording material and the second recording material passing area having a second width corresponds to a relatively smaller-sized recording material.

It is still further preferred that, in the fixing device mentioned above, the magnetic field generating device is located externally to the fixing member and a heat source of the at least one radiation heating device is located internally to the fixing member.

It is still further preferred that, in the fixing device mentioned above, the fixing member is heated by the electromagnetic induction heat generation to a fixing temperature of the fixing member at which the unfixed image can be fixed on the recording material, and is heated by the at least one radiation heating device when a relatively smaller-sized recording material passes through the fixing device after the temperature of the fixing member reaches the fixing temperature.

It is still further preferred that, in the fixing device mentioned above, the fixing member is heated by the electromagnetic induction heat generation to a fixing temperature of the fixing member at which the unfixed image can be fixed on the recording material, and is heated by the electromagnetic induction heat generation and the at least one radiation heating device when a relatively smaller-sized recording material passes through the fixing device after the temperature of the fixing member reaches the fixing temperature.

It is still further preferred that the fixing device mentioned above further includes a first temperature detecting device configured to detect the temperature of the central portion of the fixing member and a second temperature detecting device configured to detect the temperature of the end portion of the fixing member. In addition, the magnetic field generating device and the at least one radiation heating device are independently controlled based on signals output from the first temperature detecting device and the second temperature detecting device.

It is still further preferred that, in the fixing device mentioned above, the fixing member has a belt form and a heat source of the at least one radiation heating device is located internally to the fixing member.

As another aspect of the present invention, a novel transfer fixing device is provided which includes an intermediate transfer body to carry an unfixed charged toner image thereon, a transfer fixing member including a release layer to fix the unfixed charged toner image transferred from the intermediate transfer body on a recording material upon application of heat, a magnetic field generating device to generate a magnetic field by which heat is generated through electromagnetic induction heat generation in a first recording material passing area having a first width on the fixing member and at least one radiation heating device to heat a second recording material passing area having a second width on the transfer fixing member.

As another aspect of the present invention, a novel image forming apparatus is provided which includes an image bearing member, a charging device to charge the image bearing member, an irradiating device to irradiate the image bearing member to form a latent electrostatic image thereon, a developing device to develop the latent electrostatic image on the image bearing member with toner, a cleaning device to remove residual toner remaining on the image bearing member, a transfer device to transfer the toner image to a recording material and a fixing device. The fixing device includes a fixing member to fix the toner image on the recording material upon application of heat and pressure, a magnetic field generating device configured to generate a magnetic field by which heat is generated through electromagnetic induction heat generation in a first recording material passing area having a first width on the fixing member, at least one radiation heating device to heat a second recording material passing area having a second width on the fixing member, and a pressing member to press the fixing member to form a nip portion between the pressing member and the fixing member and to fix the unfixed image on the recording material together with the fixing member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention will be described below in detail with reference to several embodiments and accompanying drawings.

First, the structure of an example of a color image forming apparatus to which the present invention is applied is now described with reference to FIG. 1. The color image forming apparatus described here includes an image reading unit 100, an image forming portion 200, a manual material feeding device 300 and a material feeder portion. The image forming portion 200 has a fixing device 21 and a plurality of photoreceptors 1A, 2A, 3A and 4A arranged in a row. These photoreceptors 1A to 4A rotate in the direction indicated by the arrow in FIG. 1 and are formed of organic or inorganic materials having photoconductivity.

Color separation overlapping transfer systems are typically used for a full-color image forming apparatus based on electrophotography. Such an image forming apparatus operates as follows:

(1) Each document reading portion reads image wise light obtained by color-separation of a document reflection light into the three colors, i.e., blue, red and green.

(2) Image computation is performed based on the intensity level of each color light to obtain writing image data to be used for development of each color of yellow (Y), cyan (C), magenta (M) and black (BK).

(3) Subsequently, the obtained writing image data corresponding to each color are optically written on the four photoreceptors 1A to 4A (illustrated in FIG. 1) to obtain a latent electrostatic image for each color.

Figure 1:
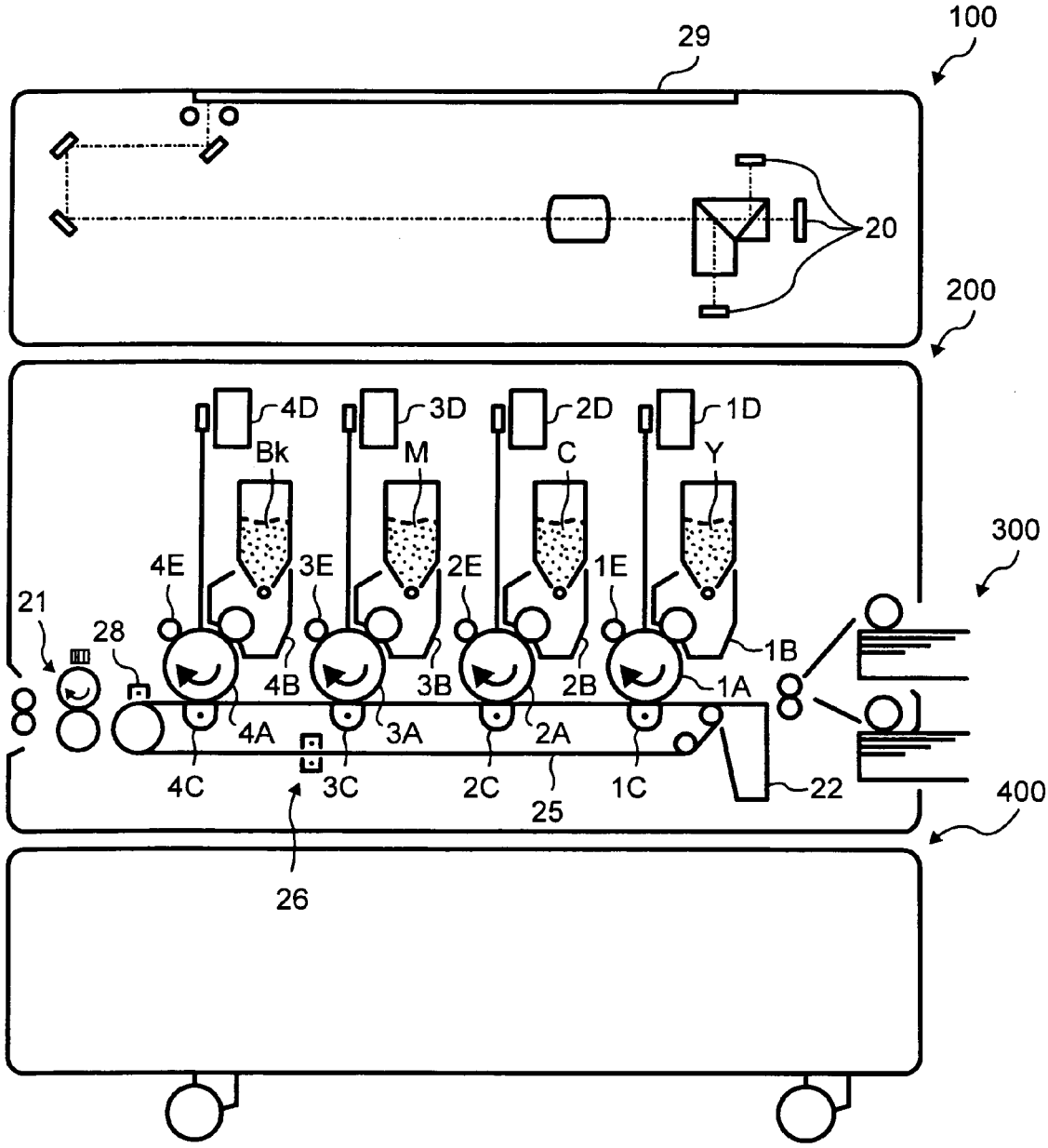
FIG. 1 is a diagram illustrating the entire structure of an image forming apparatus to which a fixing device of the present invention is applied; invention is applied.

(4) These latent electrostatic images are developed with a developer of each color of yellow, magenta, cyan and black contained in respective developing devices 1B to 4B (illustrated in FIG. 1).

In the embodiment illustrated in FIG. 1, color separation image information is optically color-separated at a document reading portion 29 disposed on the main body of the image forming apparatus and the optically color-separated information is read by three CCDs 20. Based on the signals output therefrom, each color data are obtained through computation. Using each color data, laser writing devices 1D to 4D located opposing to the photoreceptors 1A to 4A perform optical writing thereon.

The photoreceptors 1A to 4A are negatively charged by charging devices 1E to 4E. The optically written portions are reversely developed with negatively charged toner. Typical charging devices take a system in which charges generated by corona discharge performed by a corotron, scrotron, and the like, are dispersed on the surface of an image bearing member. The developing devices 1B, 2B, 3B and 4B are arranged for yellow, cyan, magenta and black, respectively, from the recording material feeding side. The developed images are overlappingly transferred in this order with a positive corona. A transfer belt 25 is formed of a dielectric material such as polyester film and positively charged by transfer charging devices 1C to 4C. Therefore, after a recording material such as paper is detached from the transfer belt 25, the transfer belt 25 is discharged by a discharging device 26. The discharging device 26 discharges (neutralizes) the charges accumulated on the transfer belt 25 from both sides by negative AC corona discharging with a charger to initialize the transfer belt 25. The toner remaining on the transfer belt 25 is removed by a cleaning unit 22.

A detachment device 28 neutralizes (discharges) the charges accumulated on a recording material by negative AC corona discharging with a charger from the top side of the recording material. Thereby, toner scattering caused by detachment discharge occurring when the recording material is detached from the transfer belt 25 can be prevented. After the recording material is detached from the transfer belt 25, the toner image on the recording material is fixed by the fixing device 21 to obtain a color image.

Examples of the present invention are now described with reference to the accompanying drawings.

Figure 2:
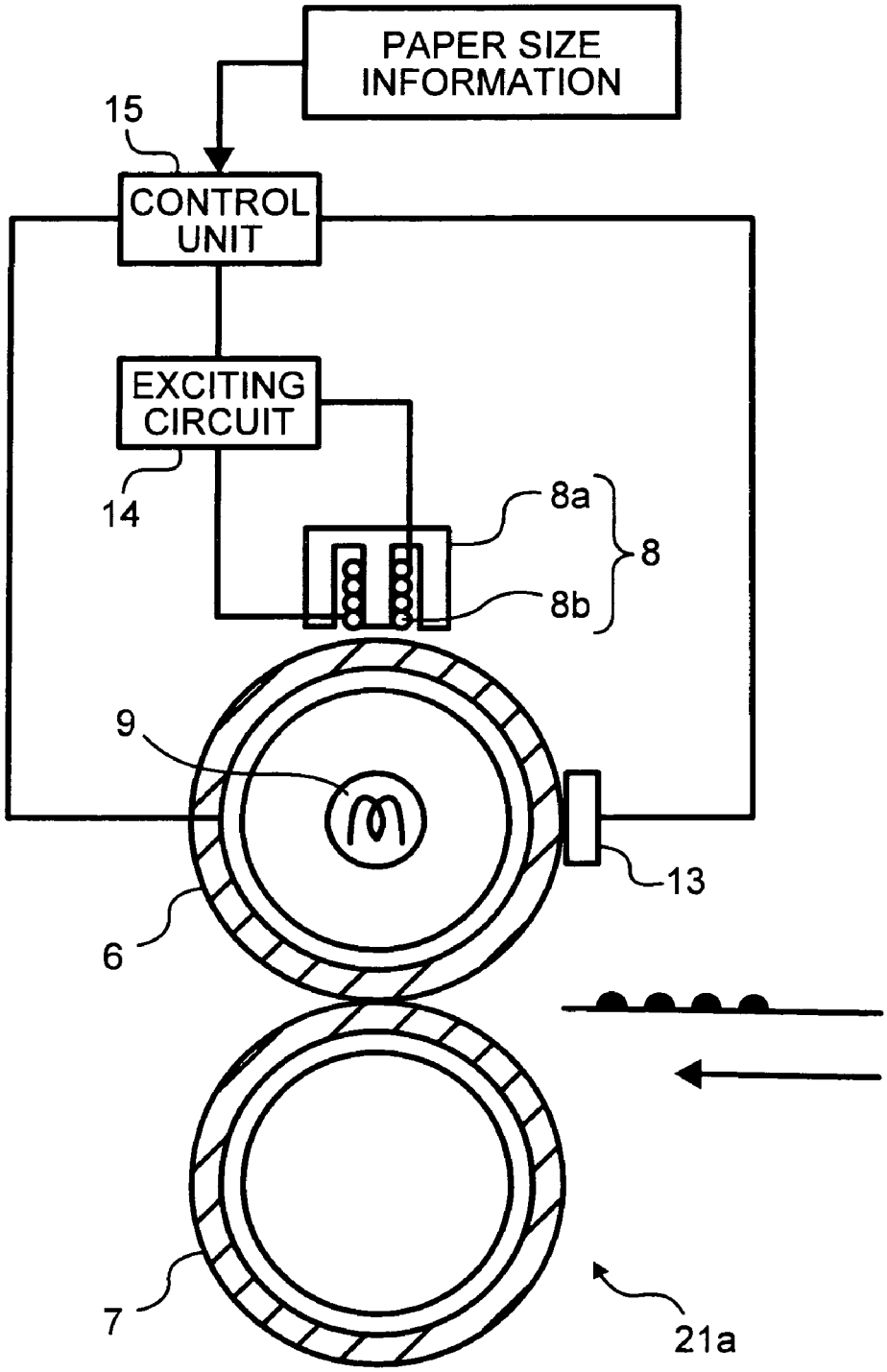
FIG. 2 is a diagram illustrating an example of the structure of the fixing device of the present invention.

FIG. 2 is a schematic diagram illustrating a fixing device 21*a* to which the present invention is applied. The fixing device 21*a* includes a fixing roller 6, a pressing roller 7, a magnetic field generating device 8 including a ferrite 8*a* and an exciting coil 8*b*, and a halogen heater 9 functioning as a radiation heating source. The fixing roller 6 forms a nip portion together with the pressing roller 7. The fixing roller 6 has an electroconductive metal core or a metal core having an electroconductive layer on its surface. Around the fixing roller 6, a temperature detecting device 13 to detect the temperature of the fixing roller 6 is provided. According to the signals output from the temperature detecting device 13, a control unit 15 controls the power supply to the exciting coil 8*b* and/or the halogen heater 9 to maintain the temperature of the fixing roller 6. As for the power supply to the exciting coil 8*b*, the control unit 15 controls an exciting circuit 14 to increase and decrease the amount of power supplied to the exciting coil 8*b*. The magnetic field generated by the magnetic field generating device 8 generates eddy current in the electroconductive layer of the fixing roller 6 and the eddy current is converted into Joule heat by the resistance of the electroconductive layer of the fixing roller 6. This is how the fixing roller 6 is heated.

The fixing roller 6 has, for example, a metal core formed of magnetic stainless material and a silicone rubber layer as an elastic layer on its surface. Further a perfluoroalkoxy ethylene copolymer (PFA) tube is coated on the silicone rubber layer as a releasing layer. Also, the fixing roller 6 possibly has a structure in which a fluoroplastic layer is provided on the metal core made of a magnetic stainless material. The pressing roller 7 can have the same structure as the fixing roller 6.

Figure 3:
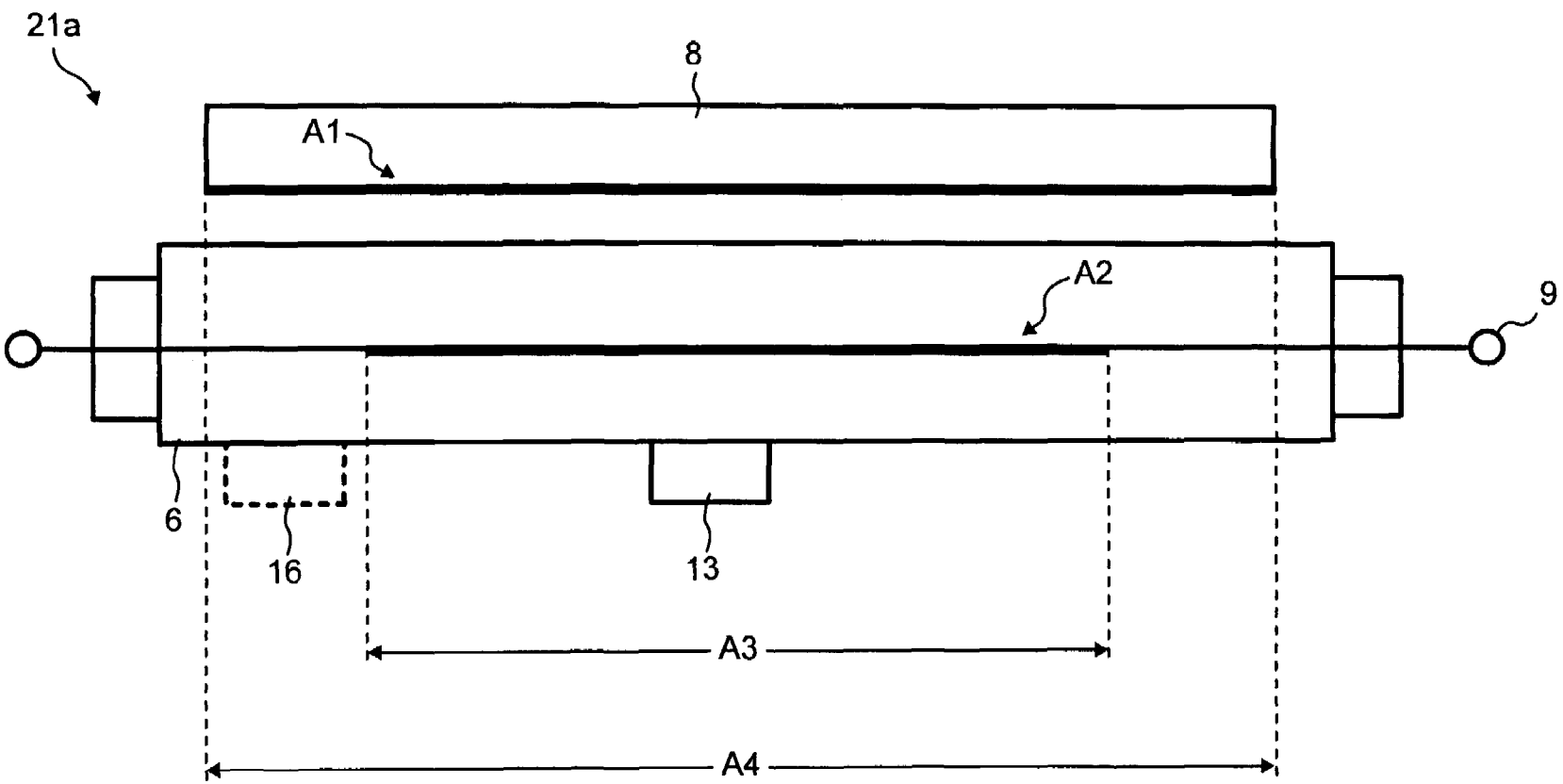
FIG. 3 is a diagram illustrating the areas heated by heat sources.

In the fixing device 21*a*, the magnetic field generating device 8 and the halogen heater 9 are located to heat respective areas of the fixing roller 6 corresponding to a different recording material width. As illustrated in FIG. 3, the magnetic field generating device 8 is set to generate heat over an area A1 corresponding to a first recording material passing area having a first width, i.e., a large-sized recording material width area A4 in this case, of the fixing roller 6. The halogen heater 9 is set to heat an area A2 corresponding to a second recording material passing area having a second width, i.e., a small sized recording material width area A3 in this case. Switching of power supply between the exciting coil 8*b* and the halogen heater 9 is performed by the control unit 15 based on the recording material size information sent thereto. When the recording material size information indicates a large-sized recording material, the power is supplied to the exciting coil 8*b*. When the recording material size information indicates a small-sized recording material, the power is supplied to the halogen heater 9. The recording material size information is obtained from the information based on document size detection, document size information at the point of data transfer, and/or size information of a tray selected.

Therefore, since the fixing device 21*a* of this example has respective heat sources for different recording material widths and the heat source is selected depending on the width of a recording material, it is possible to prevent a rise in the temperature at the end portion of the fixing roller 6 occurring while a large number of small-sized materials continuously pass through the fixing device 21*a*.

Further, the magnetic field generating device 8 is used to generate heat in the fixing roller 6 to a fixing temperature at which an unfixed image can be fixed. Furthermore, the fixing roller 6 is still heated by the magnetic field generating device 8 together with the halogen heater 9 when a small-sized recording material passes through the fixing roller 6 after the fixing roller 6 is heated to the fixing temperature. Since the small-sized portion is heated by the halogen heater 9, the intensity of the electromagnetic induction heat generation by the magnetic field generating device 8 can be relatively mild in comparison with the case in which the halogen heater 9 is not used. Therefore, the temperature of the fixing roller 6 heated outside the small-sized portion can be restrained to be low, which leads to preventing the rise in the temperature at the end portion of the fixing roller 6 occurring while a large number of small-sized materials continuously pass through the fixing device 21*a*.

As mentioned above, winding a coil around the magnetic field generating device 8 is laborious and accurate mounting is necessary therefor. Thus a required assembling property is high. Further, since its cost is high as mentioned above, when a plurality of the magnetic field generating devices 8 are provided as a preventive countermeasure for preventing a temperature from rising in the end portions of a fixing member, it results in an extreme increase in cost. Thus, in this example, only one magnetic field generating device 8 is provided and a radiation heat source is provided as a countermeasure. The fixing device 21*a* in the example is relatively easy to assemble and relatively low in cost in comparison with the case in which a plurality of the magnetic field generating devices 8 are provided.

In FIG. 2, the halogen heater 9 is provided inside the fixing roller 6, but can be provided outside the fixing roller 6. In addition, in the description above, only one halogen heater 9 is provided, but a plurality of radiation heat sources can be provided according to the size of the recording material.

A further example of a fixing device 21*b* to which the present invention is applied is described with reference to FIG. 4.

Figure 4:
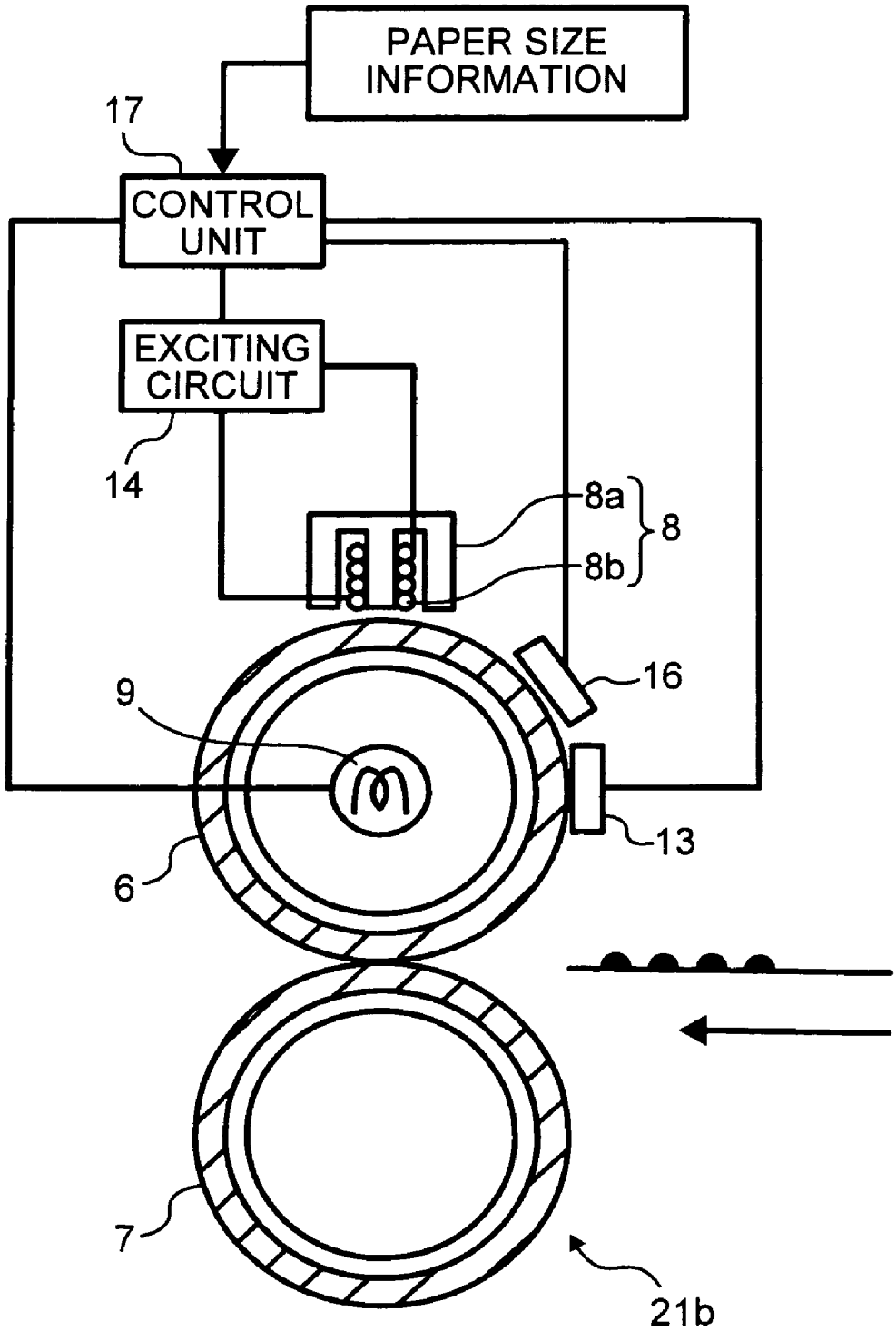
FIG. 4 is a diagram illustrating another example of the structure of a fixing device of the present invention.

In the fixing device 21*b* of FIG. 4, around a fixing roller 6, in addition to a temperature detecting device 13 detecting the temperature of the central portion of the fixing roller 6, an end portion temperature detecting device 16 detecting the end portion of the fixing roller 6 is provided. A control unit 17 controls the power supply to an exciting coil 8*b* and/or a halogen heater 9 based on the signals output from the temperature detecting device 13 and the end portion temperature detecting device 16. As illustrated in FIG. 3, the end portion temperature detecting device 16 is set in the portion of the large-sized recording material width area A4 which is outside the small sized recording material width area A3. Except for the above-mentioned portions, the structure of this example is the same as that of FIG. 2 and like numerals are provided to like corresponding parts in that example.

For the fixing device 21*b* of FIG. 4, the fixing temperature of the fixing roller 6 at which an unfixed image on a recording material can be fixed and the high and low limits of the end portion temperature are set. The high limit temperature is set to be relatively high in comparison with the fixing temperature. Heat is generated in the fixing roller 6 by electromagnetic induction by the magnetic field generating device 8 until the fixing roller 6 is heated to the fixing temperature.

When the temperature of the fixing roller 6 detected by the end portion temperature detecting device 16 surpasses the high limit temperature of the end portion while a large number of small-sized recording materials continuously pass after the fixing roller 6 is heated to the fixing temperature, the power supply is switched from the exciting coil 8*b* to the halogen heater 9. Thereafter, when the temperature of the fixing roller 6 detected by the end portion temperature detecting device 16 is below the low limit temperature of the end portion, the power supply is switched from the halogen heater 9 to the exciting coil 8*b*.

Therefore, in the fixing device 21*b* of FIG. 4, a rise in temperature at the end portion of the fixing roller 6 while a large number of small-sized recording materials continuously pass can be prevented. In addition, as in the first example of FIGS. 2 and 3, only one magnetic field generating device 8 and only one radiation heat source are used as a countermeasure for the temperature rise at the end portion. Therefore, the fixing device 21*b* in the example is relatively easy to assemble and relatively low in cost in comparison with the case in which a plurality of the magnetic field generating devices 8 are provided. Further, until the temperature of the fixing roller 6 is raised to the fixing temperature, the fixing roller 6 is heated by electromagnetic induction. Since electromagnetic induction is efficient in heating the fixing roller 6, its warm-up time can be shortened as compared with the case in which only the halogen heater 9 is used as the heat source.

Figure 5:
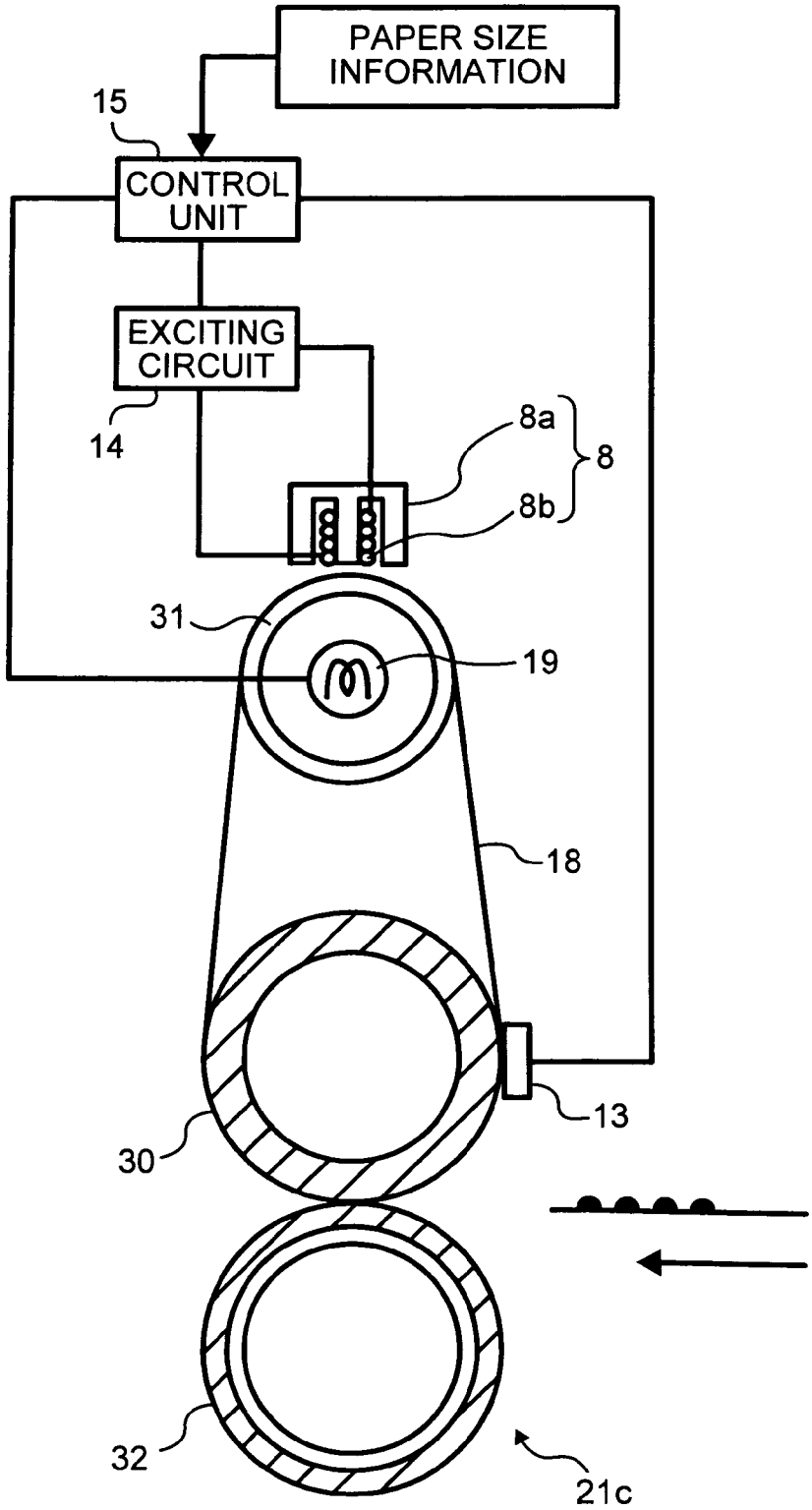
FIG. 5 is a diagram illustrating another example of the structure of a fixing device of the present invention.

A further example of a fixing device 21*c* to which the present invention is applied is described with reference to FIG. 5.

The fixing device 21*c* includes a fixing roller 30 and a heating roller 31 applying tension, a pressing roller 32, and a fixing belt 18 having an endless form suspended between the fixing roller 30 and the heating roller 31. The pressing roller 32 is in press-contact with the fixing roller 30 with the fixing belt 18 therebetween. The recording material bearing an unfixed toner image on its surface is heated and pressed in a nip portion formed between the fixing roller 30 and the pressing roller 32 with the fixing belt 18 therebetween.

Around the heating roller 31, a magnetic field generating device 8 including a ferrite 8*a* and an exciting coil 8*b* are provided. Inside the heating roller 31, a halogen heater 19 is provided. The heating roller 31 is made of a magnetic electroconductive stainless material. Around the fixing belt 18, a temperature detecting device 13 is provided to detect the temperature thereof. A control unit 15 controls the power supply to the exciting coil 8*b* and the halogen heater 19 based on the signals output from the temperature detecting device 13 to maintain the temperature of the fixing belt 18. As for the power supply to the exciting coil 8*b*, the control unit 15 increases and decreases the power supply to the exciting coil 8*b* by controlling an exciting circuit 14 based on the signals output from the temperature detecting device 13. The magnetic field generated by the magnetic field generating device 8 generates eddy current in the electroconductive layer of the heating roller 31 and the eddy current is converted into Joule heat by the resistance of the electroconductive layer of the heating roller 31. This is how the heating roller 31 is heated.

The magnetic field generating device 8 and the halogen heater 19 are located to heat respective different recording material width areas as described in the above-mentioned examples. The magnetic field generating device 8 is set to generate heat in the large-sized recording material width area A4 of the fixing belt 18 and the halogen heater 19 is set to heat the small sized recording material width area A3 thereof. The power supply is switched between the magnetic field generating device 8 and the halogen heater 19 as described in the examples of FIGS. 2 and 3.

Heat resistant resins or an endless belt form substrate formed of a metal can be used as a substrate for the fixing belt 18. Specific examples of materials for such heat resistant resins include polyimides, polyamideimides and polyether ketone (PEEK). Specific examples of materials for such metal belts include nickel, aluminum and iron. These materials preferably have a thin thickness, i.e., not greater than 100 μm. In addition, the surface thereof preferably has a good release property because the surface directly contacts a recording paper and the toner image thereon under pressure. Further, the surface preferably has a good heat resistant property and durability. Thus, the fixing belt 18 preferably has a structure having the surface coated with, for example, fluoroplastic and silicone rubber having a high releasing property. The fluoroplastic can be coated on the surface of a substrate by spraying followed by heat sealing to form a surface release layer. The silicone rubber layer having a high releasability preferably has a rubber hardness of from 25 to 65 degree (based on JIS type A) and a thickness of from 100 to 300 μm to obtain good fixability and heat responsibility. In addition, the fixing belt 18 can have another structure in which an elastic layer such as silicone rubber is provided on a substrate formed of a thermal resistant resin such as polyimide and further a release layer formed of, for example, fluoroplastic and PFA tube, is provided thereon to obtain a good fixed image in terms of transparency of a transparent sheet and uniform fixability.

The fixing roller 30 can be of a structure in which an elastic layer formed of a thermal resistant elastic body such as silicone rubber foam and liquid type silicone rubber is provided around an aluminum metal core. As for the pressing roller 32, a thermal resistant elastic layer formed of, for example, fluorine rubber and silicone rubber, can be provided on an iron or aluminum metal core and a surface release layer formed of fluoroplastic can be provided on the thermal resistant elastic layer. A heat source such as a halogen heater can be provided inside the pressing roller 32 to accelerate the speed of the temperature rise in the pressing roller 32. A driving device (not shown) drives the fixing roller 30 and/or the pressing roller 32.

Therefore, the fixing device 21*c* of this example can prevent the temperature rise in the end portion of the fixing belt 18 while small-sized recording materials continuously pass. As in the examples of FIGS. 2 and 3, the fixing device 21*c* is relatively easy to assemble and relatively low in cost in comparison with the case in which a plurality of the magnetic field generating devices 8 are provided. Further, the fixing belt 18 and the heating roller 31, both of which have a low thermal capacity, are heated by electromagnetic induction, which is efficient in heating the fixing roller 30, until the temperature of the fixing belt 18 is raised to the fixing temperature. Therefore, its warm-up time can be short. Controlling the power supply to the magnetic field generating device 8 and the halogen heater 19 are performed in the same manner as in the example of FIGS. 2 and 3. In addition, an end portion temperature detecting device to detect the temperature of the end portion of the fixing belt 18 can be provided to have the same power supply controlling system as in the example of F*ig*. 4. The other like elements to those in Example 1 are represented by the like reference numerals as in Example 1.

Figure 6:
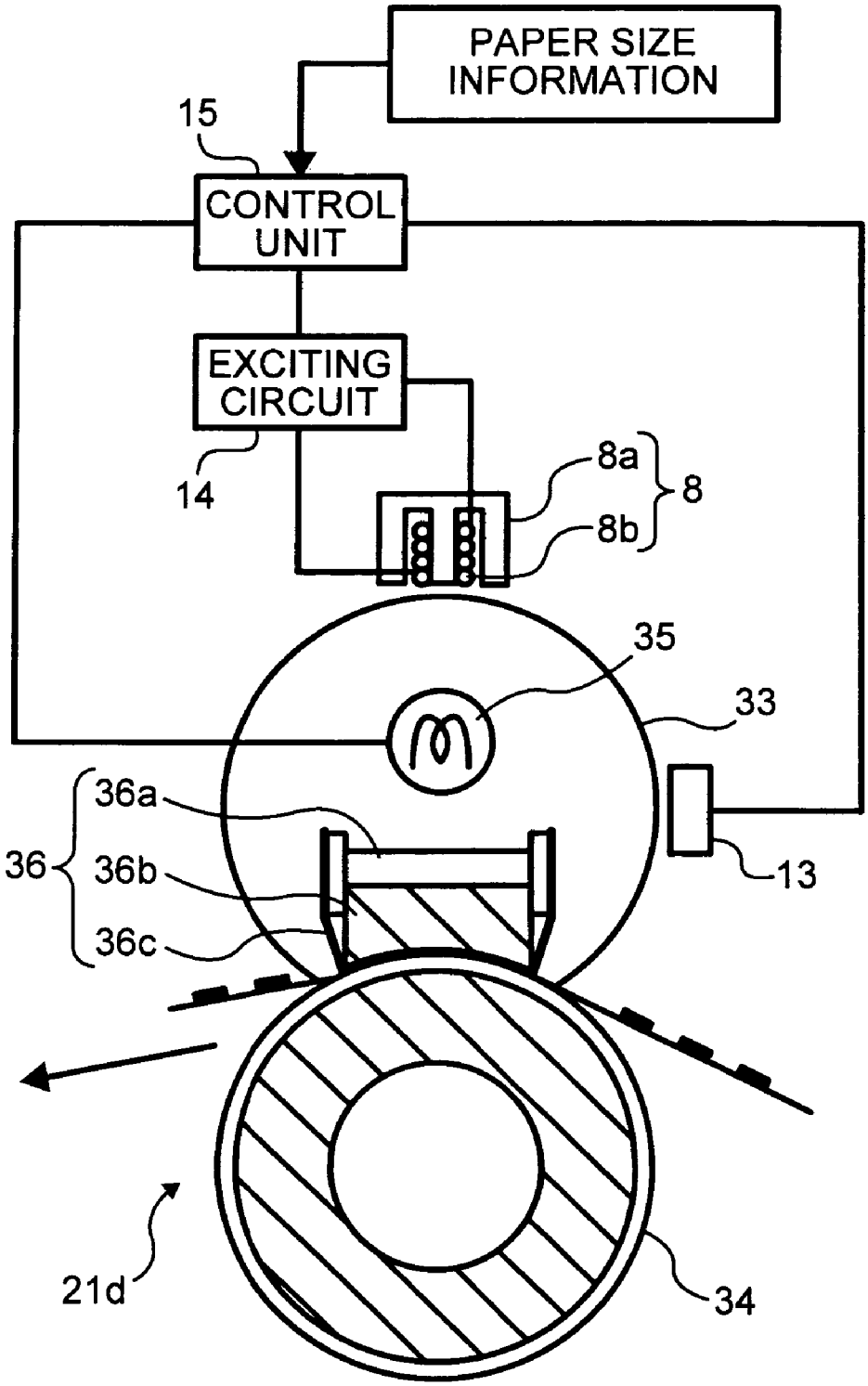
FIG. 6 is a diagram illustrating another example of the structure of a fixing device of the present invention.

A further example of a fixing device 21*d* to which the present invention is applied is described with reference to FIG. 6.

The fixing device 21*d* includes a fixing belt 33, a fixing member 36, and a pressing roller 34. The fixing member 36 is in contact with the pressing roller 34 with the fixing belt 33 therebetween. The fixing member 36 can be formed of a supporting member 36*a* formed of metal materials such as iron, stainless metals and aluminum, an elastic member 36*b* formed of silicone rubber or silicone rubber foam, and a low abrasion sheet member 36*c* formed of glass fiber resins, and the like. The pressing roller 34 includes a foam layer around a metal core and is rotationally driven by a driving device (not shown). The surface of the foam resin layer can be covered with a PFA tube. The structure of the fixing belt 33 is the same as the fixing belt 18 of the example of FIG. 5.

Around the fixing belt 33, a magnetic field generating device 8 including a ferrite 8*a* and an exciting coil 8*b* is provided. In addition, a halogen heater 35 is provided inside the fixing belt 33. Around the fixing belt 33, a temperature detecting device 13 is provided and, as in the example of FIGS. 2 and 3, a control unit 15 controls the power supply to the exciting coil 8*b* and the halogen heater 35.

The magnetic field generating device 8 and the halogen heater 35 are located to heat respective areas having a different recording material width. The magnetic field generating device 8 is set to generate heat in the large-sized recording material width area A4 of the fixing belt 33 and the halogen heater 35 is set to heat the small sized recording material width area A3 thereof. Switching of power supply between the magnetic field generating device 8 and the halogen heater 35 is the same as in the example of FIGS. 2 and 3.

Therefore, the fixing device 21*d* of this example can prevent the rise in the temperature at the end portion of the fixing belt 33 while small-sized materials continuously pass. As in the example of FIGS. 2 and 3, the fixing device 21*d* in the example is relatively easy to assemble and relatively low in cost in comparison with the case in which a plurality of the magnetic field generating devices 8 are provided. Further, only the fixing belt 33 is heated by electromagnetic induction, which is efficient in heating the fixing belt 33, until the temperature of the fixing belt 33 is raised to the fixing temperature. Therefore, its warm-up time can be further shortened. In addition, an end portion temperature detecting device to detect the temperature of the end portion of the fixing belt 33 can be provided to have the same power supply controlling system as in the example of FIG. 4. The other like elements to those in the example of FIGS. 2 and 3 are represented by the like reference numerals.

Figure 7:
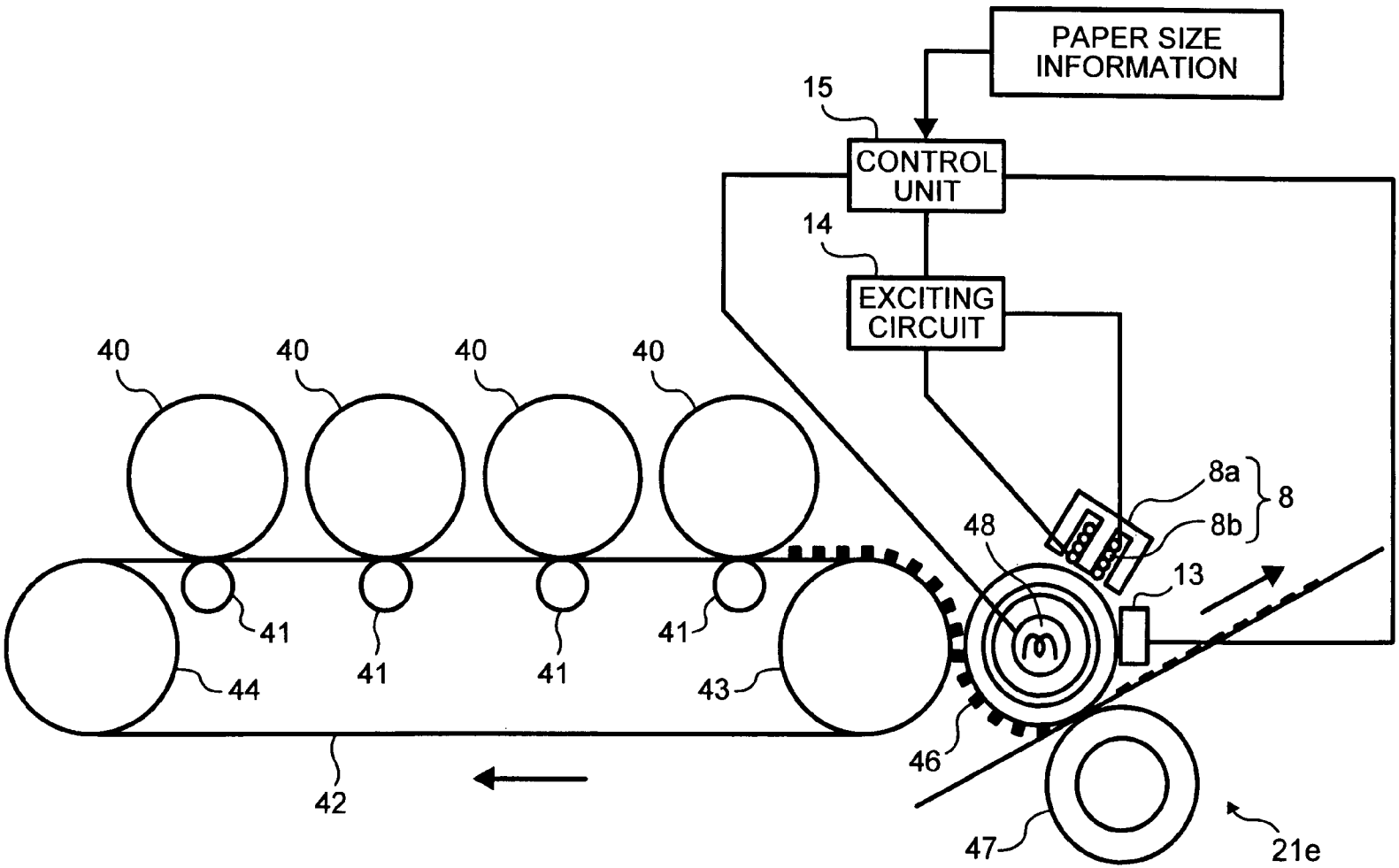
FIG. 7 is a diagram illustrating another example of the structure of a fixing device of the present invention.

A further example of a fixing device 21*e* to which the present invention is applied is described with reference to FIG. 7.

Each example mentioned above is described with reference to electropotography including processes of charging, irradiating, developing, transferring, and fixing. In addition, it is obvious that this invention can also be applied to a variant case of the electrophotography in which the toner is not transferred from the intermediate transfer body to a material but from an intermediate transfer body 42 to a transfer fixing member 46.

In the portion of the secondary transfer, a well-known desired potential difference (including overlapping of, for example, AC and pulse) is provided to control the moving direction of an image. The transfer fixing member 46 is provided to a secondary transfer member 43 with the intermediate transfer body 42 therebetween. A bias can be applied to the transfer fixing member 46 to transfer the toner on the intermediate transfer body 42. In the nip portion formed by the transfer fixing member 46 and a pressing member 47, a potential difference can be made to prevent offset. As bias generating methods, known methods such as bias application methods, grounding methods and discharging methods can be used to control current and/or voltage. A method in which a Zener diode is used to constantly maintain a predetermined potential difference is also effective. Image bearing members 40, primary transfer members 41 and intermediate transfer supporting member 44 are provided as other elements.

Around the transfer fixing member 46, a magnetic field generating device 8 including a ferrite 8*a* and an exciting coil 8*b* is provided. In addition, a halogen heater 48 is provided inside the transfer fixing member 46. Around the transfer fixing member 46, a temperature detecting device 13 is provided and, as in the example of FIGS. 2 and 3, a control unit 15 controls the power supply to the exciting coil 8*b* and the halogen heater 48.

The magnetic field generating device 8 and the halogen heater 48 are located to heat respective different recording material width areas as described in the examples of FIGS. 2 and 3. The magnetic field generating device 8 is set to generate heat in the large-sized recording material width area A4 of the transfer fixing member 46 and the halogen heater 48 is set to heat the small sized recording material width area A3 thereof. The power supply is switched between the magnetic field generating device 8 or the halogen heater 48 as described in the example of FIGS. 2 and 3.

Therefore, the fixing device 21*e* of this example can prevent the temperature rise in the end portion while small-sized recording materials continuously pass. In addition, with regard to the transferring in this example, since the secondary transfer is always performed to the same member, i.e., the transfer fixing member 46, stable and quality images can be obtained. Also, because the part of the toner is softened by heat, toner scattering during transferring is prevented so that quality images can be formed.

Controlling the power supplied to the magnetic field generating device 8 and the halogen heater 48 are performed in the same manner as in the example of FIGS. 2 and 3. In addition, an end portion temperature detecting device to detect the temperature of the end portion of the transfer fixing member 46 can be provided to have the same power supply control as the example of FIG. 4. The other similar elements to those in the example of FIGS. 2 and 3 are represented by the similar reference numerals.

With regard to the fixing and the heat in this example, heat is transferred only to the surface layer of the intermediate transfer body 42 of the secondary transfer portion via the toner. The temperature rise in the intermediate transfer body 42 is thus limited to a minimum. Therefore, problems stemming from the temperature rise in the intermediate transfer body 42 hardly occur. In addition, the heating time length of the toner can be set and it is possible to heat a recording material in the significantly same time as conventionally. Further, the time length of heating a toner and a recording material can be separately set while limiting the time length of heating the intermediate transfer body 42 to a minimum. Therefore, the time length of heating a toner, which has a significant impact on image quality such as gloss, and the time length of heating a recording material, which has a significant impact on toner adhesiveness thereto, can be freely set so that an environmental property such as saving energy by not unnecessarily heating a recording material can be achieved.

Each example mentioned above is an example in which a four-color tandem system is used. But since it is obvious that color, monochrome, and two-color image formation can be performed using one image bearing member as long as an intermediate transfer body is used, the present invention is not limited to the examples illustrated in FIGS. 2 to 7.

This document claims priority and contains subject matter related to Japanese Patent Application No. 2004-185744, filed on Jun. 24, 2004, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A fixing device, comprising:

a fixing member configured to fix an unfixed image on a recording material upon application of heat and pressure;

a magnetic field generating device configured to generate a magnetic field by which heat is generated through electromagnetic induction heat generation in a first recording material passing area having a first width on the fixing member;

at least one radiation heating device configured to heat a second recording material passing area having a second width on the fixing member; and a pressing member configured to press the fixing member to form a nip portion between the pressing member and the fixing member and to fix the unfixed image on the recording material together with the fixing member.

2. The fixing device according to claim 1, wherein the first recording material passing area having a first width corresponds to a relatively larger-sized recording material and the second recording material passing area having a second width corresponds to a relatively smaller-sized recording material.

3. The fixing device according to claim 1, wherein the magnetic field generating device is located externally to the fixing member and a heat source of the at least one radiation heating device is located internally to the fixing member.

4. The fixing device according to claim 1, wherein the fixing member is heated by the electromagnetic induction heat generation to a fixing temperature of the fixing member at which the unfixed image can be fixed on the recording material, and is heated by the at least one radiation heating device when a relatively smaller-sized recording material passes through the fixing device after the temperature of the fixing member reaches the fixing temperature.

5. The fixing device according to claim 1, wherein the fixing member is heated by the electromagnetic induction heat generation to a fixing temperature of the fixing member at which the unfixed image can be fixed on the recording material, and is heated by the electromagnetic induction heat generation and the at least one radiation heating device when a relatively smaller-sized recording material passes through the fixing device after the temperature of the fixing member reaches the fixing temperature.

6. The fixing device according to claim 1, further comprising:

a first temperature detecting device configured to detect a temperature of a central portion of the fixing member; and a second temperature detecting device configured to detect a temperature at an end portion of the fixing member, wherein the magnetic field generating device and the at least one radiation heating device are independently controlled based on signals output from the first temperature detecting device and the second temperature detecting device.

7. The fixing device according to claim 1, wherein the fixing member has a belt form and a heat source of the at least one radiation heating device is located internally to the fixing member.

8. A transfer fixing device, comprising:

an intermediate transfer body configured to carry an unfixed charged toner image thereon;

a transfer fixing member comprising a release layer, configured to fix the unfixed charged toner image transferred from the intermediate transfer body on a recording material upon application of heat;

a magnetic field generating device configured to generate a magnetic field by which heat is generated through electromagnetic induction heat generation in a first recording material passing area having a first width on the transfer fixing member; and at least one radiation heating device configured to heat a second recording material passing area having a second width on the transfer fixing member.

9. An image forming apparatus, comprising:

an image bearing member;

a charging device configured to charge the image bearing member;

an irradiating device configured to irradiate the image bearing member to form a latent electrostatic image thereon;

a developing device configured to develop the latent electrostatic image on the image bearing member with toner;

a cleaning device configured to remove residual toner remaining on the image bearing member;

a transfer device configured to transfer the toner image to a recording material; and a fixing device comprising:

a fixing member configured to fix the toner image on the recording material upon application of heat and pressure;

a magnetic field generating device configured to generate a magnetic field by which heat is generated through electromagnetic induction heat generation in a first recording material passing area having a first width on the fixing member;

at least one radiation heating device configured to heat a second recording material passing area having a second width on the fixing member; and a pressing member configured to press the fixing member to form a nip portion between the pressing member and the fixing member and to fix the unfixed image on the recording material together with the fixing member.

10. A fixing device, comprising:

means for fixing an unfixed image on a recording material upon application of heat and pressure;

means for generating a magnetic field by which heat is generated through electromagnetic induction heat generation in a first recording material passing area having a first width on the means for fixing;

means for heating a second recording material passing area independent of the means for generating a magnetic field, the second recording material passing area having a second width on the means for fixing; and means for pressing the means for fixing to form a nip portion between the means for pressing and the means for fixing and to fix the unfixed image on the recording material together with the means for fixing.

11. The fixing device according to claim 10, wherein the first recording material passing area having a first width corresponds to a relatively larger-sized recording material and the second recording material passing area having a second width corresponds to a relatively smaller-sized recording material.

12. The fixing device according to claim 10, wherein the means for generating a magnetic field is located externally to the means for heating and a heat source of the means for heating is located internally to the means for fixing.

13. The fixing device according to claim 10, wherein the means for fixing is heated by the electromagnetic induction heat generation to a fixing temperature of the means for fixing at which the unfixed image can be fixed on the recording material, and is heated by the means for heating when a relatively smaller-sized recording material passes through the fixing device after the temperature of the means for fixing reaches the fixing temperature.

14. The fixing device according to claim 10, wherein the means for fixing is heated by the electromagnetic induction heat generation to a fixing temperature of the means for fixing at which the unfixed image can be fixed on the recording material, and is heated by the electromagnetic induction heat generation and the means for heating when a relatively smaller-sized recording material passes through the fixing device after the temperature of the fixing member reaches the fixing temperature.

15. The fixing device according to claim 10, further comprising:

a first means for detecting a temperature of a central portion of the means for fixing; and a second means for detecting a temperature at an end portion of the means for fixing, wherein the means for generating a magnetic field and the means for heating are independently controlled based on signals output from the first means for detecting a temperature and the second means for detecting a temperature.

16. The fixing device according to claim 10, wherein the means for fixing has a belt form and a heat source of the means for heating located internally to the means for fixing.

17. A transfer fixing device, comprising:

means for intermediately carrying an unfixed charged toner image thereon;

means for transfer-fixing the unfixed charged toner image transferred from the means for intermediately carrying on a recording material upon application of heat;

means for generating a magnetic field by which heat is generated through electromagnetic induction heat generation in a first recording material passing area having a first width on the means for fixing; and means for heating a second recording material passing area independent of the means for generating a magnetic field, the second recording material passing area having a second width on the means for transfer-fixing.

18. An image forming apparatus, comprising:

means for bearing an image;

means for charging the means for bearing an image;

means for irradiating the means for bearing an image to form a latent electrostatic image thereon;

means for developing the latent electrostatic image on the means for bearing an image with toner;

means for removing residual toner remaining on the means for bearing an image;

means for transferring the toner image to a recording material; and means for fixing comprising:

means for fixing the toner image on the recording material upon application of heat and pressure;

means for generating a magnetic field by which heat is generated through electromagnetic induction heat generation in a first recording material passing area having a first width on the means for fixing;

means for heating a second recording material passing area independent of the means for generating a magnetic field, the second recording material passing area having a second width on the means for fixing; and means for pressing the means for fixing to form a nip portion between the means for pressing and the means for fixing and to fix the unfixed image on the recording material together with the means for fixing.

* * * * *